US009939235B2

(12) United States Patent
Daniels et al.

(10) Patent No.: US 9,939,235 B2
(45) Date of Patent: Apr. 10, 2018

(54) INITIATION DEVICES, INITIATION SYSTEMS INCLUDING INITIATION DEVICES AND RELATED METHODS

(71) Applicant: Battelle Energy Alliance, LLC, Idaho Falls, ID (US)

(72) Inventors: Michael A. Daniels, Idaho Falls, ID (US); Reston A. Condit, Idaho Falls, ID (US); Nikki Rasmussen, Logan, UT (US); Ronald S. Wallace, Ucon, ID (US)

(73) Assignee: Battelle Energy Alliance, LLC, Idaho Falls, ID (US)

( * ) Notice: Subject to any disclaimer, the term of this patent is extended or adjusted under 35 U.S.C. 154(b) by 1204 days.

(21) Appl. No.: 14/049,614

(22) Filed: Oct. 9, 2013

(65) Prior Publication Data

US 2016/0356580 A1 Dec. 8, 2016

(51) Int. Cl.
*F42B 3/14* (2006.01)
*F42B 3/12* (2006.01)

(52) U.S. Cl.
CPC ..... *F42B 3/14* (2013.01); *F42B 3/124* (2013.01)

(58) Field of Classification Search
CPC ..... F42B 3/10; F42B 3/14; F42B 3/124
USPC ..... 102/201, 315
See application file for complete search history.

(56) References Cited

U.S. PATENT DOCUMENTS 2,935,648 A 5/1960 Buntenbach
3,160,789 A * 12/1964 Morgan ..... F42B 3/124 102/202.7
3,166,689 A 1/1965 Buntenbach
3,169,482 A 2/1965 Noble
3,198,118 A 8/1965 Lorenz
3,248,603 A 4/1966 Howell et al.
3,264,989 A 8/1966 Rucker
3,288,068 A 11/1966 Jefferson et al.
3,314,361 A 4/1967 Olson et al.
3,320,889 A 5/1967 Holtz
3,344,744 A * 10/1967 Bankston, Jr. ..... F42B 3/14 102/202.1
3,346,762 A 10/1967 Martin
(Continued)

FOREIGN PATENT DOCUMENTS

EP 679859 A2 11/1995
EP 679859 A3 7/1996
WO 2006054293 A2 5/2006

*Primary Examiner* — Joshua Freeman
(74) *Attorney, Agent, or Firm* — TraskBritt

(57) ABSTRACT

Initiation devices may include at least one substrate, an initiation element positioned on a first side of the at least one substrate, and a spark gap electrically coupled to the initiation element and positioned on a second side of the at least one substrate. Initiation devices may include a plurality of substrates where at least one substrate of the plurality of substrates is electrically connected to at least one adjacent substrate of the plurality of substrates with at least one via extending through the at least one substrate. Initiation systems may include such initiation devices. Methods of igniting energetic materials include passing a current through a spark gap formed on at least one substrate of the initiation device, passing the current through at least one via formed through the at least one substrate, and passing the current through an explosive bridge wire of the initiation device.

19 Claims, 8 Drawing Sheets

(56) References Cited

U.S. PATENT DOCUMENTS 3,351,012 A 11/1967 Wilson
3,363,566 A 1/1968 Giattino et al.
3,418,510 A 12/1968 Melhart
3,449,999 A * 6/1969 Coler ..... F42B 3/124 86/1.1
3,562,639 A 2/1971 Wright et al.
3,562,640 A 2/1971 Wright et al.
3,624,451 A 11/1971 Gauld
3,689,830 A 9/1972 Caldwell et al.
3,757,697 A 9/1973 Phinney
3,797,393 A 3/1974 Marchandise et al.
3,913,484 A 10/1975 Gardner
4,103,619 A * 8/1978 Fletcher ..... F42B 3/185 102/202.5
4,141,297 A 2/1979 Sellwood
4,145,970 A 3/1979 Hedberg et al.
4,179,992 A * 12/1979 Ramnarace ..... F42C 19/10 102/470
4,227,461 A 10/1980 Beezley et al.
4,246,845 A 1/1981 Winton et al.
4,261,263 A * 4/1981 Coultas ..... F42B 3/18 102/202.7
4,307,663 A * 12/1981 Stonestrom ..... F42B 3/18 102/202.4
4,422,381 A * 12/1983 Barrett ..... F42B 3/18 102/202.12
4,616,565 A * 10/1986 Reinovsky ..... F42B 3/103 102/202.5
4,708,060 A * 11/1987 Bickes, Jr. ..... F42B 3/13 102/202.5
4,840,122 A 6/1989 Nerheim
4,938,137 A * 7/1990 Guay ..... F42B 3/124 102/202.7
5,070,789 A 12/1991 True et al.
5,080,016 A 1/1992 Osher
5,099,762 A * 3/1992 Drapala ..... F42B 3/188 102/202.1
5,140,906 A * 8/1992 Little, II ..... F42B 3/103 102/202.14
5,179,249 A 1/1993 Bement et al.
5,230,287 A * 7/1993 Arrell, Jr. ..... F42B 3/195 102/202.5
5,431,104 A * 7/1995 Barker ..... F42B 3/128 102/202.7
5,433,147 A * 7/1995 Brede ..... F42B 3/103 102/202.2
5,465,030 A 11/1995 Smith
5,479,860 A 1/1996 Ellis
5,549,046 A 8/1996 Widner et al.
5,639,986 A * 6/1997 Evans ..... B60R 21/2644 102/202.1
5,641,935 A 6/1997 Hunter et al.
5,648,634 A * 7/1997 Avory ..... C06B 33/06 102/202.1
5,672,841 A * 9/1997 Monk ..... F42B 3/185 102/202.1
5,847,309 A * 12/1998 Baginski ..... F42B 3/13 102/202.2
5,920,029 A 7/1999 Teaford
5,932,832 A * 8/1999 Hansen ..... B60R 21/2644 102/202.2
5,992,326 A * 11/1999 Martinez-Tovar ..... F42B 3/13 102/202.4
6,199,484 B1 * 3/2001 Martinez-Tovar ..... F42B 3/18 102/202.4
6,467,414 B1 * 10/2002 Fisher ..... F42B 3/121 102/202.3
6,591,754 B1 * 7/2003 Baur ..... B60R 21/01 102/206
6,732,655 B1 * 5/2004 Jakob ..... F42B 3/18 102/202.1
6,739,264 B1 * 5/2004 Hosey ..... F42B 3/121 102/202.2
8,485,097 B1 * 7/2013 Nance ..... F42B 3/18 102/200
2004/0083919 A1 * 5/2004 Hosey ..... F42B 3/121 102/202.12
2008/0250963 A1 * 10/2008 Fink ..... F42B 3/103 102/202.8
2010/0282105 A1 * 11/2010 Neyer ..... F42B 3/18 102/202.1
2010/0313783 A1 * 12/2010 Hansen ..... F42B 3/14 102/202.8
2012/0227608 A1 * 9/2012 Givens ..... F42B 3/121 102/311
2013/0239834 A1 * 9/2013 Kraft ..... F42B 3/12 102/202.9

* cited by examiner

INITIATION DEVICES, INITIATION SYSTEMS INCLUDING INITIATION DEVICES AND RELATED METHODS

STATEMENT REGARDING FEDERALLY SPONSORED RESEARCH OR DEVELOPMENT

This invention was made with government support under Contract No. DE-AC07-05ID14517 awarded by the United States Department of Energy. The government has certain rights in the invention.

TECHNICAL FIELD

Embodiments of the present disclosure relate generally to initiation devices and systems. In particular, the present disclosure relate generally relates to initiation devices for initiation of energetic materials, systems including initiation devices, and methods of igniting devices including one or more energetic materials using initiation devices.

BACKGROUND

Energetic materials may be initiated by initiation or detonation devices. Due to the destructive nature of energetic materials, such as explosives, these devices may incorporate various safety features to avoid premature initiation of the energetic materials. Energetic materials may be ignited in several different ways. Typically, energetic materials have been ignited by flame ignition (e.g., fuzes or ignition of a priming explosive), impact (which often ignites a priming explosive), chemical interaction (e.g., contact with a reactive or activating fluid), or electrical ignition. Electrical ignition may occur in two distinct ways, as by ignition of a priming material (e.g., electrically ignited blasting cap or priming material) or by direct energizing of an explosive mass by electrical power.

Remote activation systems for initiation of energetic materials have been used widely in the field of military and industrial demolition applications. Control systems (e.g., a fireset) may be used to generate an electrical impulse for initiating an energetic material. For example, a blasting cap used in conjunction with an explosive charge (e.g., pentaerythritol tetranitrate (PETN), C4, etc.) can be electrically connected to output terminals of the initiation device using electrical conductors. In many instances, the initiation assembly including an initiation device and associated control system is sensitive to electrical conditions, such as voltage and current transients (e.g., electrostatic discharge (ESD)) and electromagnetic interference (EMI). As a result of this sensitivity, premature initiation of the explosive charge has been known to occur with unacceptable frequency. The results of premature initiation can include unintended damage and/or unintended personal injury or death.

The use of initiation devices with energetic materials, such as non-high explosive materials (e.g., low explosives that decompose primarily through deflagration), may present further problems as non-high explosive materials may be inadvertently ignited by the heating and/or combustion of the initiation device. For example, voltage and current transients in the initiation device and associated control system may cause the unintended heating and combustion of components of the initiation device (e.g., an exploding bridge wire (EBW)). Such unintended heating and combustion may result in the premature initiation of the non-high explosive materials associated with the initiation device.

BRIEF SUMMARY

In some embodiments, the present disclosure includes an initiation device. The initiation device includes at least one substrate configured to electrically couple with a control system and an initiation element configured to ignite an energetic material. The initiation element is positioned on a first side of the at least one substrate. The initiation device further includes a spark gap electrically coupled to the initiation element. The spark gap is positioned on a second side of the at least one substrate. The initiation device is configured such that a current resulting from a voltage supplied to the initiation device from the control system passes through the spark gap before initiating the initiation element.

In additional embodiments, the present disclosure includes an initiation device. The initiation device includes a plurality of substrates configured to electrically couple with a control system. At least one substrate of the plurality of substrates is electrically connected to at least one adjacent substrate of the plurality of substrates with at least one via extending through the at least one substrate. The initiation device further includes an initiation element configured to ignite an energetic material and positioned on one substrate of the plurality of substrates and a spark gap electrically coupled to the initiation element and positioned on another substrate of the plurality of substrates. The initiation element is electrically connected to the spark gap with the at least one via.

In yet additional embodiments, the present disclosure includes an initiation system. The initiation system includes a control system and at least one initiation device configured to be electrically connected to the control system.

In yet additional embodiments, the present disclosure includes a method of igniting energetic material. The method comprises supplying a voltage to an initiation device, passing a current resulting from the voltage through a spark gap formed on at least one substrate of the initiation device, passing the current through at least one via formed through the at least one substrate of the initiation device, and passing the current through an explosive bridge wire of the initiation device to ignite the explosive bridge wire.

BRIEF DESCRIPTION OF THE SEVERAL VIEWS OF THE DRAWINGS

While the specification concludes with claims particularly pointing out and distinctly claiming that which is regarded as embodiments of the present disclosure, the advantages of embodiments of the disclosure may be more readily ascertained from the following description of embodiments of the disclosure when read in conjunction with the accompanying drawings in which:

DETAILED DESCRIPTION

The illustrations presented herein are not meant to be actual views of any particular material, device, apparatus, system, or method, but are merely idealized representations that are employed to describe embodiments of the present disclosure. Additionally, elements common between figures may retain the same numerical designation for convenience and clarity.

Figure 1:
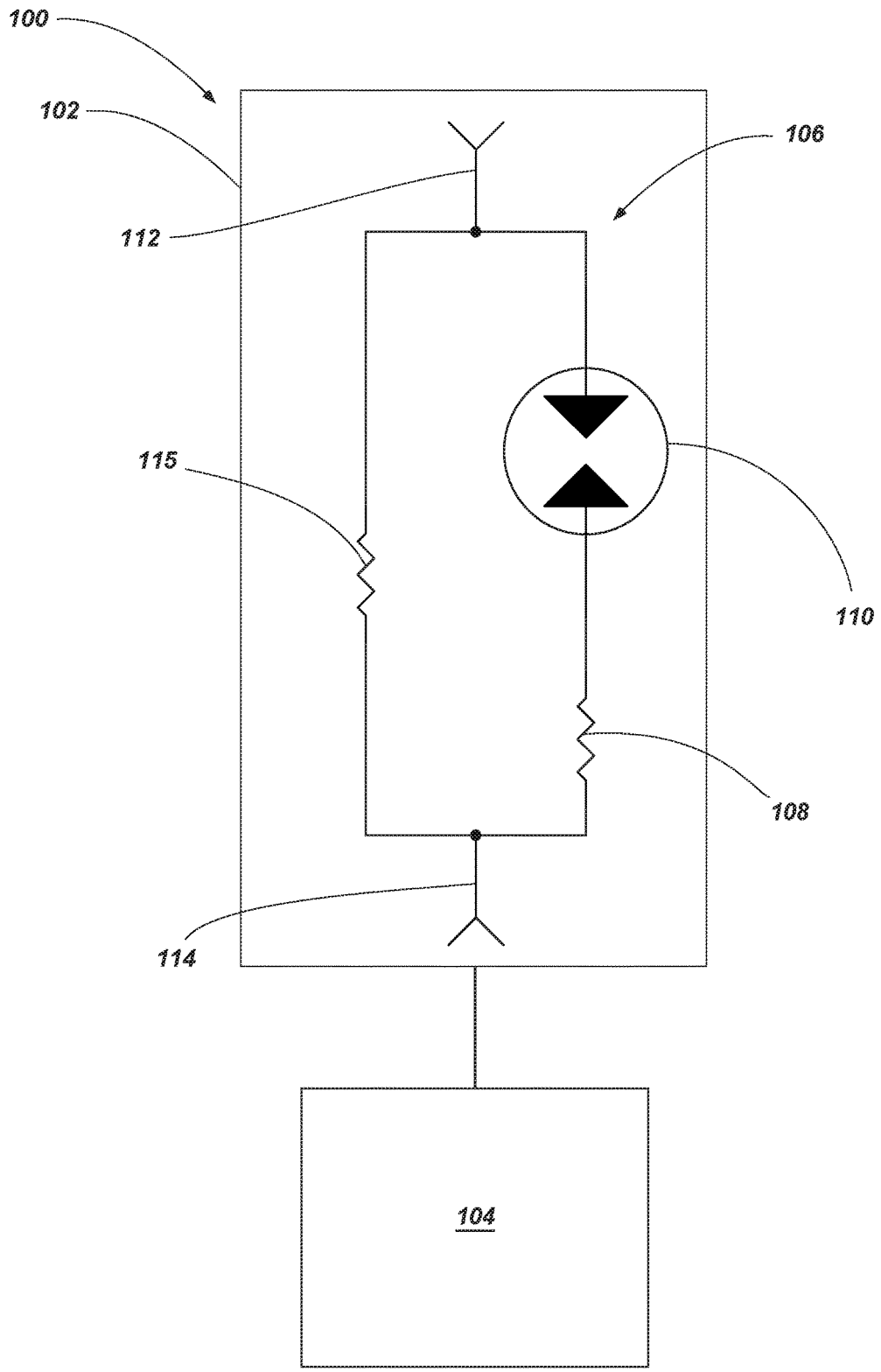
FIG. 1 is a simplified schematic block diagram of an initiation system including an initiation device and control system in accordance with an embodiment of the present disclosure.

FIG. 1 is a schematic view of an initiation system 100 including an initiation device 102 and control system 104. As shown in FIG. 1, a circuit 106 of the initiation device 102 is illustrated. The circuit 106 is electrically connected to the control system 104 (e.g., a fireset) in order to receive a signal from the control system 104 to ignite a portion of the initiation device 102. For example, the circuit 106 may include an initiation element 108 for igniting an explosive material such as, for example, an exploding bridge wire (EBW) (e.g., a gold exploding bridge wire (EBW)). In other embodiments, the initiation element 108 may comprise a different type of initiation element (e.g., an exploding foil initiator (EFI), a low energy exploding foil initiator (LEEFI), a blasting cap).

The initiation element 108 is configured to ignite one or more of energetic materials (e.g., explosive materials, reactive materials, combustible materials, incendiary materials, and combinations thereof). For example, the exploding bridge wire 108 may be configured to ignite an explosive material, such as, for example, a non-high explosive material or low explosive material that decomposes primarily through deflagration (e.g., a subsonic combustion propagated, for example, through thermal conductivity rather than a supersonic combustion (i.e., detonation)). For example, the low explosive material may include, but is not limited to, pyrotechnic compositions (e.g., thermites, flares, fireworks, etc.), propellants, incendiary materials or devices, and gunpowders. In other embodiments, the initiation element 108 may be configured to ignite other energetic materials that decompose by differing mechanisms (e.g., detonation).

The circuit 106 includes an electrical feature (e.g., a spark gap 110) coupled to the initiation element 108 for regulating the amount of one or more of voltage and current that is passed through the circuit 106. For example, the spark gap 110 may be electrically coupled to (e.g., in series with) the initiation element 108. The spark gap 110 requires a threshold voltage to be supplied to the circuit 106 before an electric spark (e.g., an electric arc) will pass between conductors of the spark gap 110 that are separated by a fluid. As depicted, the voltage may be provided by leads (e.g., a first lead 112 and a second lead 114 that have an electrical potential therebetween such as, for example, a positive lead and a negative lead) that are electrically coupled to the control system 104. In some embodiments, at least a portion of the initiation device 102 may be sealed (e.g., hermetically sealed) such that the gap of the spark gap 110 may comprise a gas different than the atmosphere in which the initiation device 102 is placed such as, for example, an inert gas (e.g., argon). In other embodiments, the gap of the spark gap 110 may comprise atmospheric air.

When the voltage provided from lead 112 is greater than a threshold voltage, current may pass through spark gap 110 and the initiation element 108 to lead 114. In some embodiments, the threshold voltage may be between 500 and 2000 volts (e.g., at least 500 volts, at least 750 volts, at least 1000 volts, at least 1500 volts).

In some embodiments, the circuit 106 may include resistor 115 (e.g., a 10 MΩ 100 MΩ resistor) positioned between the leads 112, 114 (e.g., in parallel with one or more of the initiation element 108 and the spark gap 110). Resistor 115 may provide a closed circuit loop (e.g., as opposed to the parallel open circuit loop including the spark gap 110). Such a closed circuit loop may be required by the control system 104 in order to initiate the initiation device 102.

The control system 104 may include any system, assembly, or device capable of supplying an electrical signal (e.g., voltage) to the initiation device 102. For example, the control system 104 may comprise an electric system capable of supplying a signal to the initiation device 102 in order to initiate the initiation element 108 of the initiation device 102. In some embodiments, the control system 104 may be remotely controlled enabling a user to remotely initiate the initiation device 102 with the control system 104.

In some embodiments, the control system 104 may include a safe and arm device (also termed a SAD or an S&A). Safe and arm devices may include an assembly or system that mechanically and/or electrically (i.e., electronic safe and arm devices (ESADs)) interrupts a firing train and prevents inadvertent functioning of an initiation assembly. For example, an ESAD may isolate electronic components between a power source and a detonator to inhibit inadvertent firing of the system. Such a control system 104 including an ESAD may supply a voltage to the initiation device 102 only when it is desired to ignite the initiation device 102.

Figure 2:
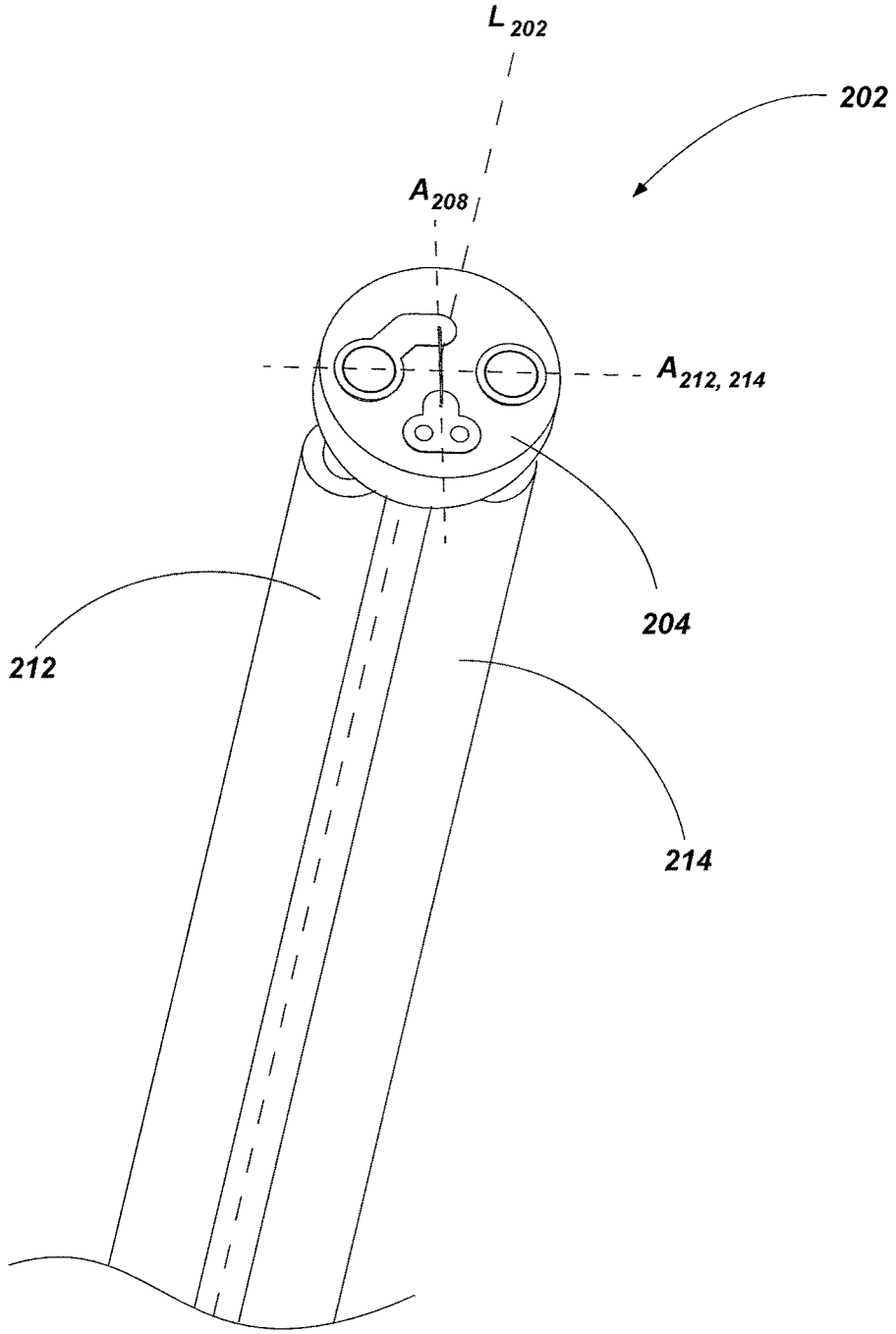
FIG. 2 is a perspective view of an embodiment of an initiation device of the present disclosure.

FIG. 2 is a perspective view of an embodiment of an initiation device 202 that may be similar to and include one or more of the components and configurations of the initiation device 102 discussed above with reference to FIG. 1. As shown in FIG. 2, the initiation device 202 includes leads 212, 214 electrically coupled to a substrate 204 (e.g., a glass-reinforced epoxy laminate such as FR4). As above, the leads 212, 214 may be electrically coupled a control system (e.g., control system 104 (FIG. 1)).

Figure 3:
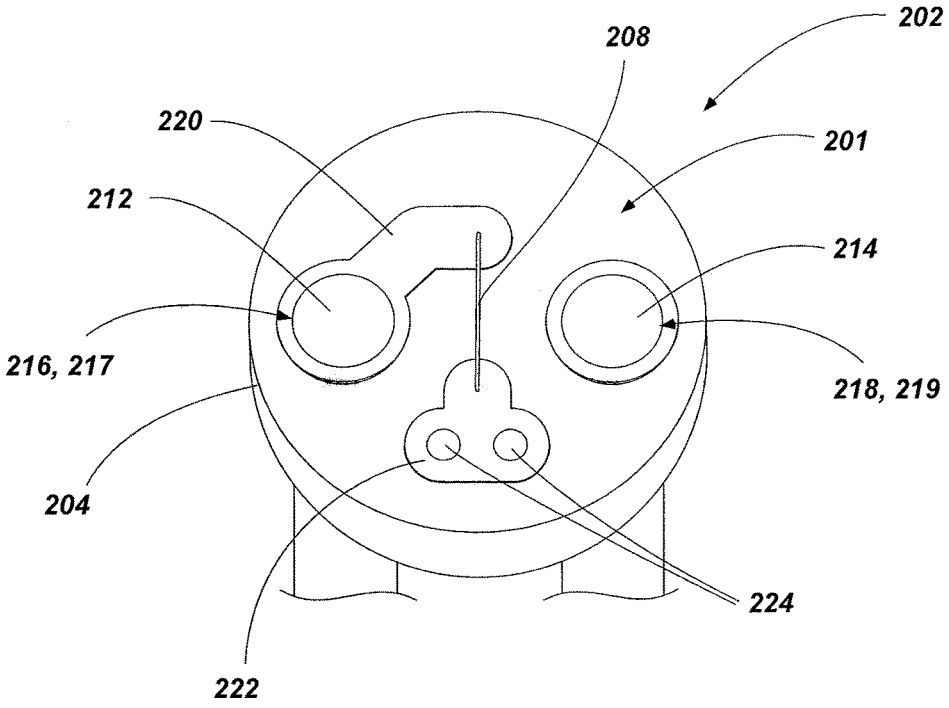
FIGS. 3 and 4 are side views of a portion the initiation device shown in FIG. 2.
Figure 4:
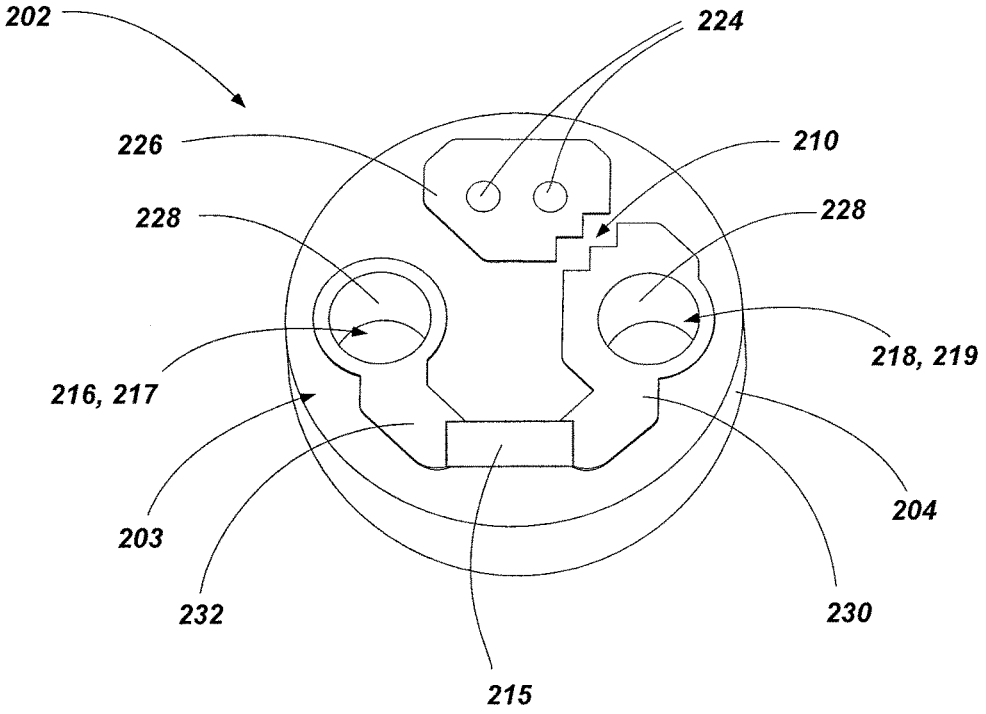

FIGS. 3 and 4 are side views of a portion of the initiation device 202 shown in FIG. 2. In particular, FIG. 3 illustrates a first side 201 of the substrate 204 of the initiation device 202 and FIG. 4 illustrates a second side 203 of the substrate 204 of the initiation device 202 (e.g., where the second side 203 opposes the first side 201). It is noted that, for purposes of illustration, FIG. 3 is shown having leads 212, 214 attached to the substrate 204 while FIG. 4 is shown with the leads 212, 214 removed. As shown in FIGS. 3 and 4, the initiation device 202 includes one or more vias (e.g., first via 216 and second via 218) extending between the first side 201 and the second side 203 of the substrate 204. In some embodiments, the substrate 204 may include conductive material 228 in apertures 217, 219 of the vias 216, 218 extending through the substrate 204 to provide an electrical connection between the first side 201 and the second side 203 of the substrate 204. In some embodiments, the leads 212, 214 may be received in the apertures 217, 219 of the vias 216, 218 to provide an electrical connection between the first side 201 of the substrate 204 and the second side 203 of the substrate 204 in addition to or instead of the conductive material 228. In other embodiments, the leads 212, 214 may be coupled (e.g., soldered) to the substrate 204 without being received in an aperture in the substrate 204. As depicted, the conductive material 228 may extend around the apertures 217, 219 such that the apertures 217, 219 may still receive the leads 212, 214 therein. In other embodiments, the conductive material 228 may substantially or entirely fill the apertures 217, 219.

Lead 212 and via 216 may be electrically connected to conductive material on the first side 201 of the substrate 204 (e.g., first conductive trace 220). The first conductive trace 220 may be electrically connected to a first portion of an initiation element 208 (e.g., a first end of an exploding bridge wire (EBW)). A second portion of the initiation element 208 (e.g., a second, opposing end of an exploding bridge wire (EBW)) may be electrically connected to conductive material on the first side 201 of the substrate 204 (e.g., second conductive trace 222). The second conductive trace 222 may be electrically connected to conductive material (e.g., third conductive trace 226) on the second side 203 of the substrate 204. For example, one or more vias 224 may extend through the substrate 204 to electrically connect the second conductive trace 222 to the third conductive trace 226).

Lead 214 and via 218 may be electrically connected to conductive material on the second side 203 of the substrate 204 (e.g., fourth conductive trace 230). A spark gap 210 between the third conductive trace 226 and the fourth conductive trace 230 may provide a selective electrical connection between the third conductive trace 226 and the fourth conductive trace 230 (e.g., a connection made only when the voltage supplied by the leads 212, 214 exceeds a threshold amount). In other words, lead 212 is permanently electrically connected (e.g., constantly connected) to the first portion of the initiation element 208 and lead 214 is selectively electrically connected (e.g., intermittently connected) to the second portion of the initiation element 208 via the spark gap 210.

As discussed above in relation to FIG. 1, the leads 212, 214 may also be connected via a resistor 215 (e.g., a 10 MΩ to 100 MΩ resistor) to provide a closed circuit loop (e.g., as opposed to the parallel open circuit loop including the spark gap 210). For example, lead 212 and via 216 may connect to conductive material on the second side 203 of the substrate 204 (e.g., fifth conductive trace 232). Fourth conductive trace 230 and fifth conductive trace 232 may be electrically connected via the resistor 215.

Referring to FIGS. 2 and 3, in some embodiments, the initiation element 208 and leads 212, 214 may be positioned on or in the substrate 204 such that the initiation element 208 is offset from the leads 212, 214 about (e.g., around) a longitudinal axis $L_{202}$ of the initiation device 202. For example, the initiation element 208 may be offset about 90 degrees from the leads 212, 214 about the longitudinal axis $L_{202}$ of the initiation device 202. In some embodiments, an axis $A_{212,\ 214}$ extending between a portion of the leads 212, 214 connected (e.g., coupled) to the substrate 204 may be offset from (e.g., transverse, perpendicular) an axis $A_{208}$ extending along at least a portion of the initiation element 208 (e.g., along the longitudinal axis of the exploding bridge wire (EBW)).

Figure 5:
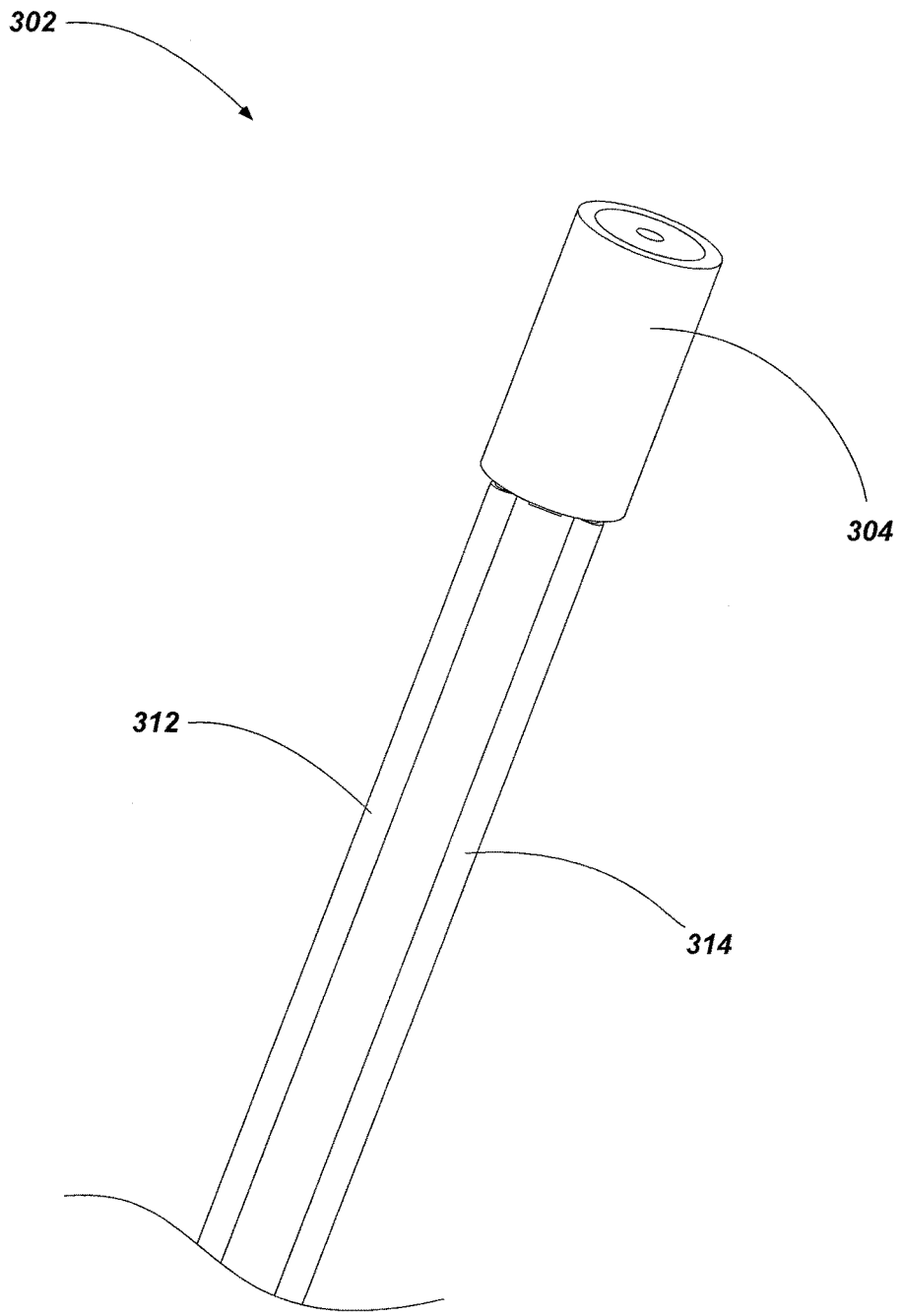
FIG. 5 is a perspective view of an embodiment of an initiation device of the present disclosure.

FIG. 5 is a perspective view of an embodiment of an initiation device 302 that may be similar to and include one or more of the components and configurations of the initiation devices 102, 202 discussed above with reference to FIGS. 1 through 4. As shown in FIG. 5, the initiation device 302 includes leads 312, 314 and a housing 304. As above, the leads 312, 314 may be electrically coupled a control system (e.g., control system 104 (FIG. 1)).

Figure 6:
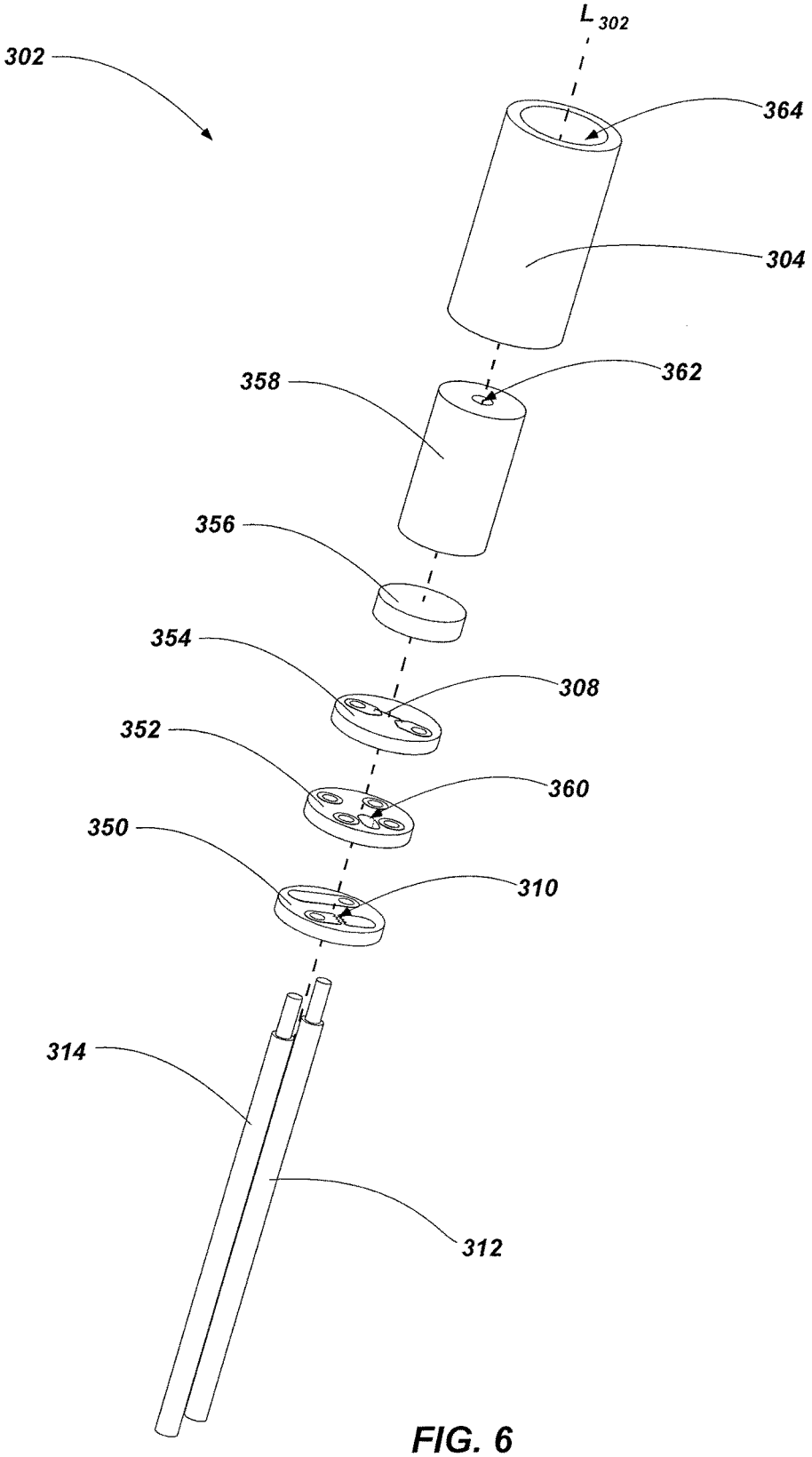
FIG. 6 is an exploded perspective view of the initiation device shown in FIG. 5.

FIG. 6 is an exploded perspective view of the initiation device 302 shown in FIG. 5. As shown in FIG. 6, the initiation device 302 includes multiple components within the housing 304. For example, the initiation device 302 may include multiple substrates having electrical connections and features thereon and one or more energetic materials (e.g., explosive materials, reactive materials, combustible materials, incendiary materials, and combinations thereof) positioned within the housing 304 (e.g., assembled along a longitudinal axis $L_{302}$ of the initiation device 302).

As depicted, the initiation device 302 includes a first substrate 350 for connecting (e.g., coupling) to the leads 312, 314 and including a spark gap 310. The initiation device 302 includes a second substrate 352 positioned adjacent the first substrate 350 and having an aperture 360 in the second substrate 352 for forming a cavity about the gap of the spark gap 310. For example, as discussed above, the aperture 360 may be sealed within the housing 304 such that a selected fluid (e.g., gas) may be provided in the gap of the spark gap 310. The initiation device 302 includes a third substrate 354 positioned adjacent the second substrate 352 having an initiation element 308 (e.g., an exploding bridge wire (EBW)).

The initiation device 302 includes one or more materials positioned proximate the initiation element 308 on the third substrate 354 that are to be initiated by (e.g., ignited by) the initiation element 308. For example, a first reactive material 356 (e.g., a thermite) may be positioned adjacent to (e.g., in contact with) the initiation element 308 and a second reactive material 358 (e.g., a thermite that is less reactive than the thermite of the first reactive material 356) may be positioned adjacent to (e.g., in contact with) the first reactive material 356. In some embodiments, the second reactive material 358 may have an aperture 362 formed in the second reactive material 358 (e.g., along the longitudinal axis $L_{302}$ of the initiation device 302). During decomposition (e.g., combustion) of the second reactive material 358, the aperture 362 may form a jet of combusting material that may exit the housing 304 (e.g., through an open end 364 of the housing 304) to assist in the ignition of another material (e.g., an energetic material such as a low explosive material) that the initiation device 302 is intended to initiate.

It is noted that, in some embodiments, the initiation device 202 may include a housing and one or more energetic materials disposed therein in a manner similar to the initiation device 302.

Figure 7:
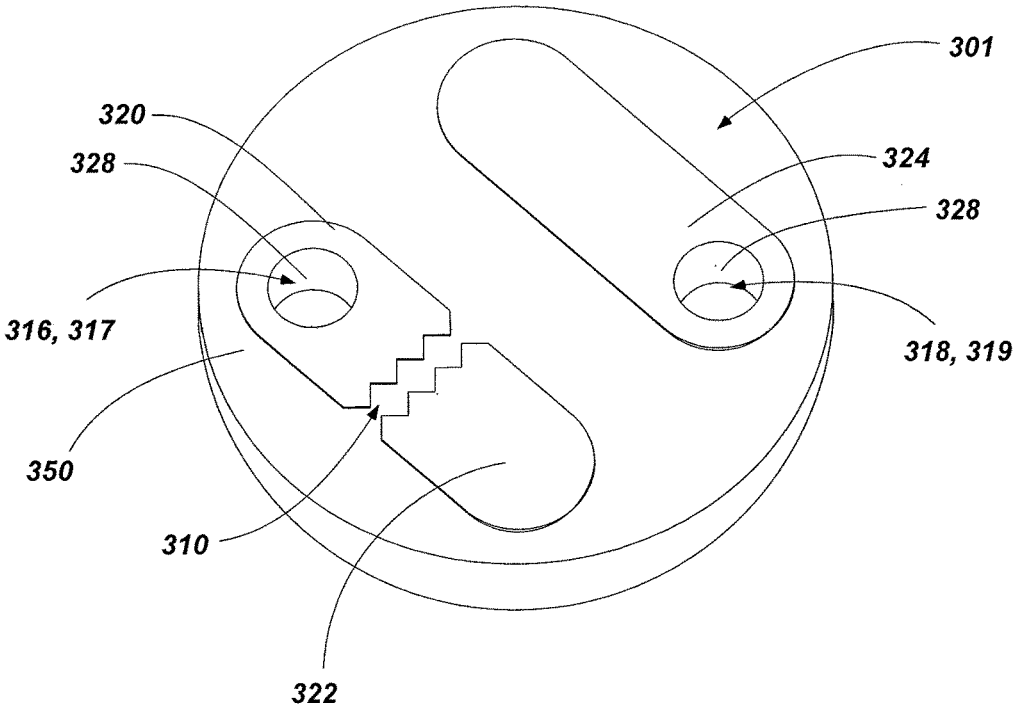
FIGS. 7 and 8 are side views of a portion of the initiation device shown in FIG. 5.
Figure 8:
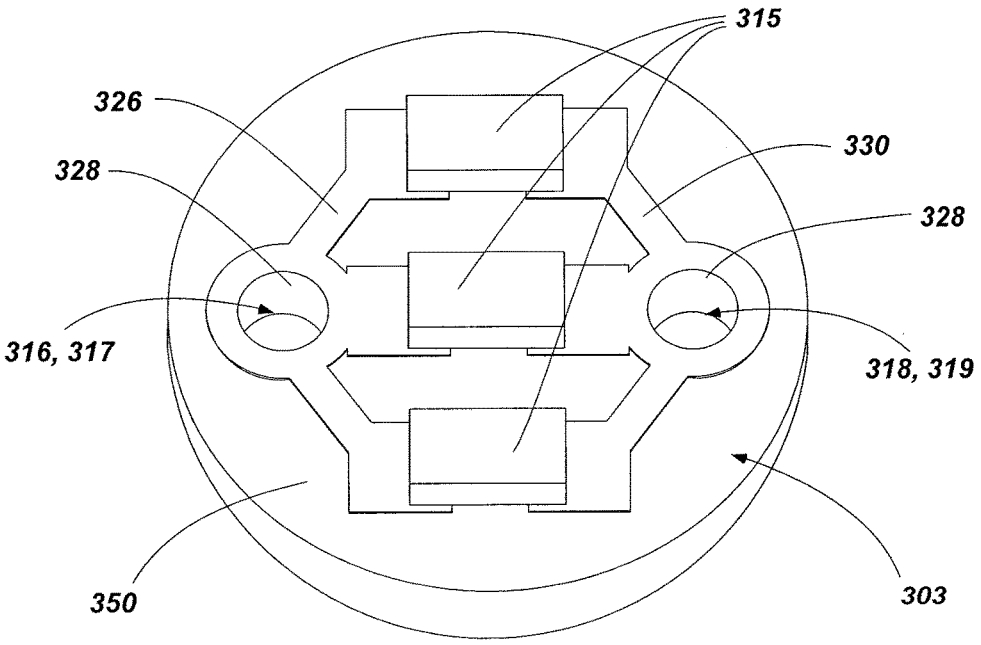

FIGS. 7 and 8 are side views of a portion of the initiation device 302 shown in FIG. 5. In particular, FIG. 7 illustrates a first side 301 of the first substrate 350 of the initiation device 302 and FIG. 8 illustrates a second side 303 of the first substrate 350 of the initiation device 302 (e.g., where the second side 303 opposes the first side 301). As shown in FIGS. 7 and 8, the first substrate 350 includes one or more vias (e.g., first via 316 and second via 318) extending between the first side 301 and the second side 303. In some embodiments, the first substrate 350 may include conductive material 328 in apertures 317, 319 of the vias 316, 318 extending through the first substrate 350 to provide an electrical connection between the first side 301 and the second side 303 of the first substrate 350. In some embodiments, the leads 312, 314 (FIGS. 5 and 6) may be received in the apertures 317, 319 of the vias 316, 318 to provide an electrical connection between the first side 301 of the first substrate 350 and the second side 303 of the first substrate 350 in addition to or instead of the conductive material 328.

As discussed above, the conductive material 328 may extend around the apertures 317, 319 maintaining an opening in the apertures 317, 319. In other embodiments, the conductive material 328 may substantially or entirely fill the apertures 317, 319. In other embodiments, the leads 312, 314 may be coupled (e.g., soldered) to the first substrate 350 without being received in an aperture in the first substrate 350.

Lead 312 (FIGS. 5 and 6) and via 316 may be electrically connected to conductive material on the first side 301 of the first substrate 350 (e.g., first conductive trace 320). Another conductive material on the first side 301 of the first substrate 350 (e.g., second conductive trace 322) may be positioned proximate the first conductive trace 320 to form a spark gap 310 therebetween. The spark gap 310 may provide a selective electrical connection between the first conductive trace 320 and the second conductive trace 322 (e.g., a connection made only when the voltage supplied by the leads 312, 314 (FIGS. 5 and 6) exceeds a threshold amount). In other words, lead 312 is permanently electrically connected (e.g., constantly connected) to the first portion of the initiation element 308 (FIG. 6) and lead 314 is selectively electrically connected (e.g., intermittently connected) to the second portion of the initiation element 308 via the spark gap 310.

Lead 314 (FIGS. 5 and 6) and via 318 may be electrically connected to conductive material on the first side 301 of the first substrate 350 (e.g., third conductive trace 324). The third conductive trace 324 and the combination of the first conductive trace 320 and the second conductive trace 322 may each extend across the first side 301 of the first substrate 350 to provide an offset between the leads 312, 314 and initiation element 308 (FIG. 6) such as that described above with reference to FIGS. 2 through 4.

As discussed above in relation to FIG. 1, the leads 312, 314 (FIGS. 5 and 6) may also be connected via one or more resistors 315 (e.g., collectively forming a 10 MΩ to 100 MΩ resistor) to provide a closed circuit loop (e.g., as opposed to the parallel open circuit loop including the spark gap 310). For example, lead 312 and via 316 may connect to conductive material on the second side 303 of the first substrate 350 (e.g., fourth conductive trace 326) and lead 314 and via 318 may connect to another conductive material on the second side 303 of the first substrate 350 (e.g., fifth conductive trace 330). Fourth conductive trace 326 and fifth conductive trace 330 may be electrically connected via the resistors 315.

Figure 9:
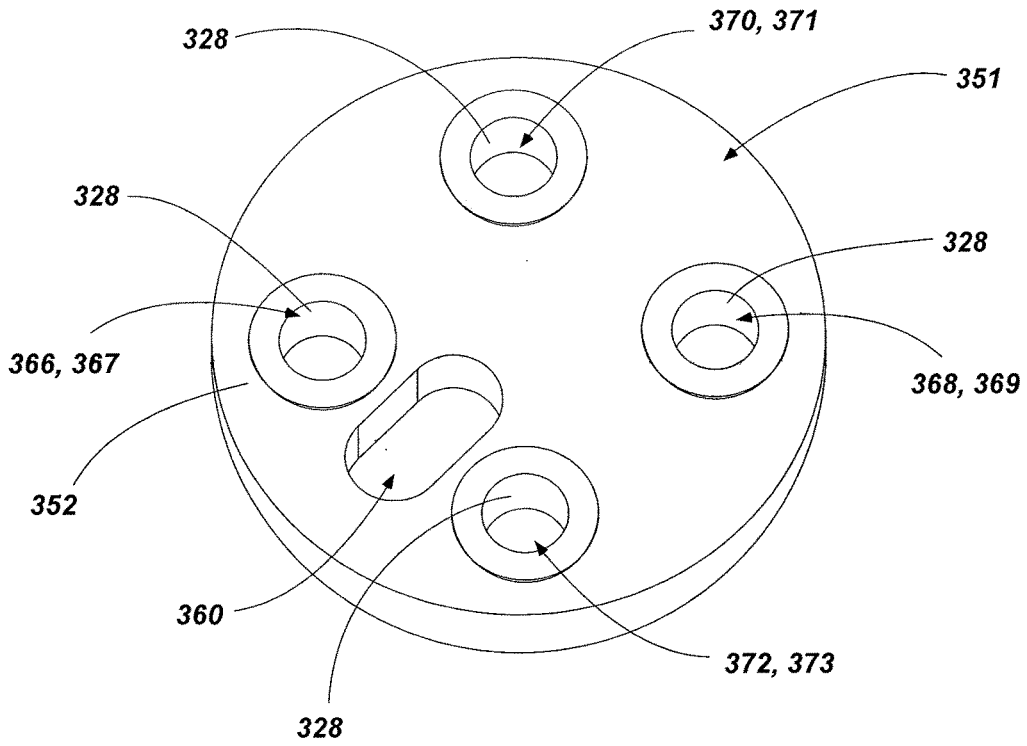
FIGS. 9 and 10 are side views of a portion of the initiation device shown in FIG. 5.
Figure 10:
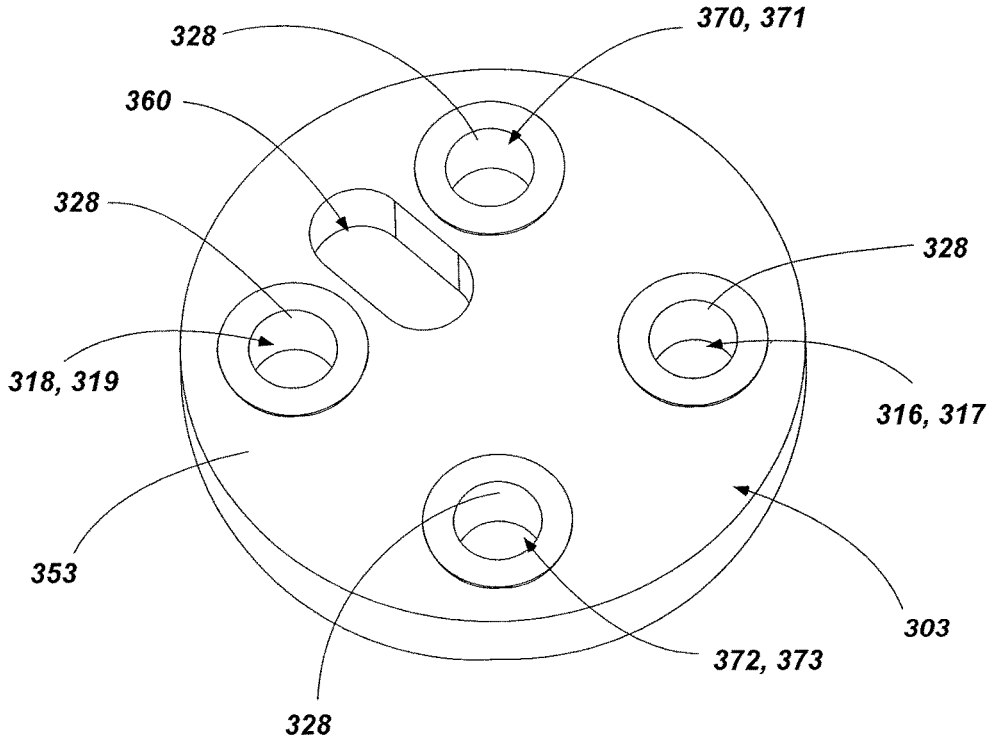

FIGS. 9 and 10 are side views of a portion of the initiation device 302 shown in FIG. 5. In particular, FIG. 9 illustrates a first side 351 of the second substrate 352 of the initiation device 302 and FIG. 10 illustrates a second side 353 of the second substrate 352 of the initiation device 302 (e.g., where the second side 353 opposes the first side 351). In some embodiments, the first side 351 of the second substrate 352 may be similar to (e.g., identical to) second side 353 of the second substrate 352. As shown in FIGS. 9 and 10, the second substrate 352 includes one or more vias (e.g., first via 366, second via 368, third via 370, and fourth via 372) extending between the first side 351 and the second side 353. In some embodiments, the second substrate 352 may include conductive material 328 in apertures 367, 369, 371, 373 of the vias 366, 368, 370, 372 extending through the second substrate 352 to provide an electrical connection between the first side 351 of the second substrate 352 and the second side 353 of the second substrate 352. In some embodiments, the leads 312, 314 (FIGS. 5 and 6) may be received in the apertures 367, 369 of the vias 366, 368 in addition to the apertures 317, 319 of the vias 316, 318 (FIGS. 7 and 8) to provide an electrical connection between the first side 351 of the second substrate 352 and the second side 353 of the second substrate 352 in addition to or instead of the conductive material 328.

Vias 370, 372 may be electrically connected to the second conductive trace 322 and the third conductive trace 324 on the first side 351 of the first substrate 350 (FIGS. 7 and 8).

As mentioned above, the aperture 360 in the second substrate 352 may form a cavity about the gap of the spark gap 310 (FIGS. 7 and 8).

Figure 11:
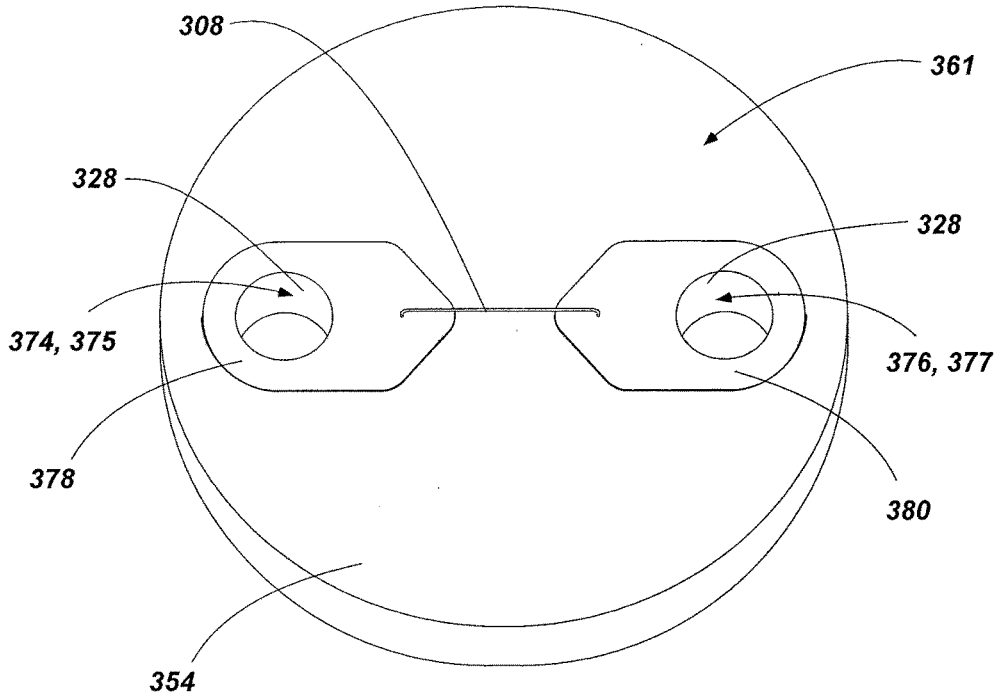
FIGS. 11 and 12 are side views of a portion of the initiation device shown in FIG. 5.
Figure 12:
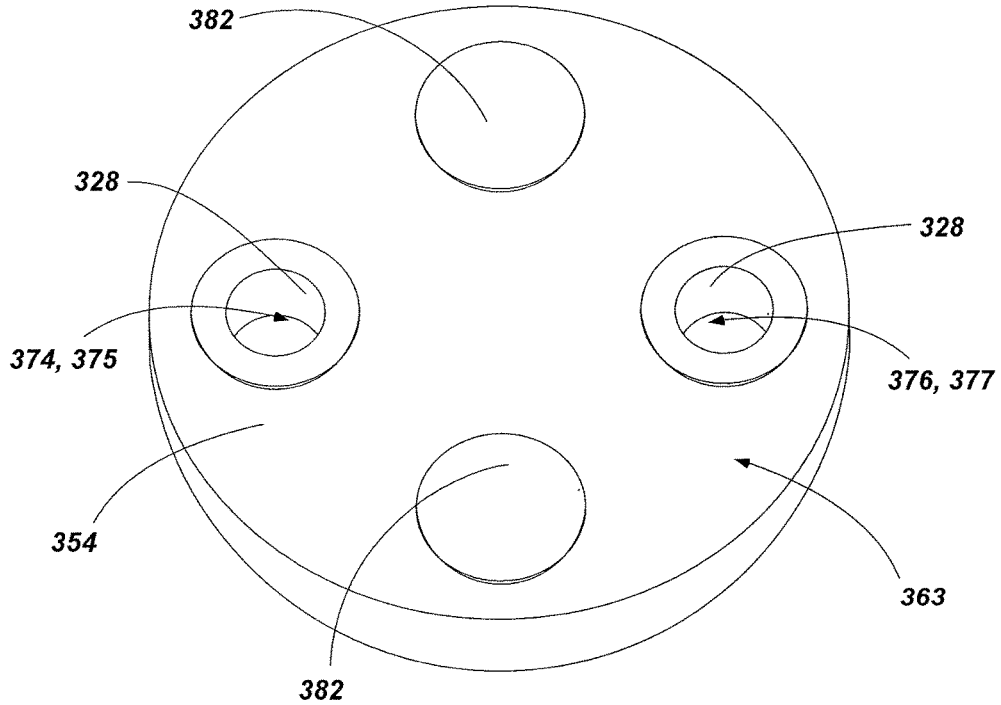

FIGS. 11 and 12 are side views of a portion of the initiation device 302 shown in FIG. 5. In particular, FIG. 11 illustrates a first side 361 of the third substrate 354 of the initiation device 302 and FIG. 12 illustrates a second side 363 of the third substrate 354 of the initiation device 302 (e.g., where the second side 363 opposes the first side 361). As shown in FIGS. 11 and 12, the third substrate 354 includes one or more vias (e.g., first via 374 and second via 376) extending between the first side 361 and the second side 363. In some embodiments, the third substrate 354 may include conductive material 328 in apertures 375, 377 of the vias 374, 376 extending through the third substrate 354 to provide an electrical connection between the first side 361 of the third substrate 354 and the second side 363 of the third substrate 354.

Vias 374, 376 may be electrically connected to the vias 370, 372 of the second substrate 352 (FIGS. 9 and 10). Via 374 may be electrically connected to conductive material on the first side 361 of the third substrate 354 (e.g., sixth conductive trace 378) and via 376 may be electrically connected to another conductive material on the first side 361 of the third substrate 354 (e.g., seventh conductive trace 380). The sixth conductive trace 378 may be electrically connected to a first portion of the initiation element 308 (e.g., a first end of an exploding bridge wire (EBW)). A second portion of the initiation element 308 (e.g., a second, opposing end of an exploding bridge wire (EBW)) may be electrically connected to the seventh conductive trace 380.

In some embodiments, the third substrate 354 may include conductive materials 382 that are electrically connected to the vias 366, 368 of the second substrate 352 (FIGS. 9 and 10). Such conductive materials 382 may each form an end portion of the apertures 317, 319, 367, 369 of the first and second substrates 350, 352 (FIGS. 7 through 10) in which the leads 312, 314 (FIGS. 5 and 6) may be received.

Referring to FIGS. 1, 2, and 5, in operation, a control system 104 supplies a voltage to initiation device 102, 202, 302 to initiate the initiation device 102, 202, 302. For example, the voltage supplied by control system 104 may initiate the initiation element 108, 208, 308.

Referring to FIGS. 2 through 4, the control system 104 (FIG. 1) may supply a voltage across leads 212, 214. A current resulting from the voltage passes through an electrical connection of the initiation device 202 to the initiation element 208. The electrical connection may extend from the second lead 214 to the fourth conductive trace 230, across the spark gap 210, to third conductive trace 226, through the vias 224, to the second conductive trace 222, and to the to the second portion of the initiation element 208. Another electrical connection of the initiation device 202 passes the current back to the control system 104. The another electrical connection may extend from the first portion of the initiation element 208 through the via 216 through the first conductive trace 220 and the via 216 to the first lead 212.

By way of further example, referring to FIGS. 5 through 12, the control system 104 (FIG. 1) may supply a voltage across leads 312, 314. For example, a current resulting from the voltage passes through an electrical connection of the initiation device 302 to the initiation element 308. The electrical connection may extend from the first lead 312 to the first conductive trace 320, across the spark gap 310, to second conductive trace 322, through the via 372, through the via 374, to the sixth conductive trace 378, and to the first portion of the initiation element 308. Another electrical connection of the initiation device 302 passes the current back to the control system 104. For example, the another electrical connection may extend from the second portion of the initiation element 308, to the seventh conductive trace 380, through the via 376, through the via 370, to the third conductive trace 324, through the via 318, and to the second lead 314.

As discussed above, the voltage supplied by control system 104 may initiate the initiation element 108, 208, 308. For example, the voltage may combust the initiation element 108, 208, 308 such as, for example, an exploding bridge wire (EBW). The energy (e.g., thermal energy) from the combustion of the exploding bridge wire may initiate (e.g., ignite) a material positioned proximate the exploding bridge wire. For example, as shown in FIG. 6, the combustion of the exploding bridge wire may ignite material (e.g., reactive materials 356, 358) within the housing 304 of the initiation device 302, which may, in turn, be utilized to ignite another energetic material. In other embodiment, as shown in FIGS. 2 through 4, the combustion of the exploding bridge wire may ignite an explosive, combustible, or reactive material positioned adjacent to the initiation element 208 of the initiation device 202. As noted above, in some embodiments, the initiation device 202 may include one or more of a housing and one or more energetic materials.

It is noted that initiation devices and control systems may be utilized in numerous applications such as, for example, military, mining and drilling operations, demolition, and any suitable pyrotechnic application.

Embodiments of the present disclosure may be particularly useful in providing initiation devices having relatively greater reliability, safety, and compatibility as compared to conventional initiation devices employing similar components. For example, embodiments of initiation devices as disclosed herein may be particularly useful in igniting materials that decompose primarily through deflagration rather than detonation. In some embodiments, the initiation device may output primarily thermal energy with little to no shock wave and a minimal pressure wave.

Furthermore, embodiments of initiation devices as disclosed herein may also provide an initiation device that protects against inadvertent firing due to low voltage, high current stray voltage initiation and high voltage, low current stray voltage initiation. For example, the spark gap of the initiation device protects against low voltage, high current stray voltage initiation as the spark gap is selected to only pass voltage to the initiation element at a voltage higher than a threshold voltage. The exploding bridge wire of the initiation device protects against high voltage, low current stray voltage initiation as the exploding bridge wire will not initiate explosive, combustible, or reactive material positioned proximate the exploding bridge wire as the exploding bridge wire will not provide sufficient heating until the current reaches a threshold value.

While the present disclosure may be susceptible to various modifications and alternative forms, specific embodiments have been shown by way of example in the drawings and have been described in detail herein. However, it should be understood that the disclosure is not intended to be limited to the particular forms disclosed. Rather, the disclosure includes all modifications, equivalents, legal equivalents, and alternatives falling within the scope of the disclosure as defined by the following appended claims.

What is claimed is:

1. An initiation device, comprising:

at least one substrate configured to electrically couple with a control system;

an initiation element configured to ignite an energetic material, the initiation element positioned on a first side of the at least one substrate; and a spark gap electrically coupled to the initiation element, the spark gap positioned on a second side of the at least one substrate, wherein the initiation device is configured to pass a current resulting from a voltage supplied to the initiation device from the control system through the spark gap from a first side of the spark gap, over the spark gap, and to a second side of the spark gap, the initiation device further configured to, after passing the current through the spark gap, pass the current to the initiation element in order to initiate the initiation element.

2. The initiation device of claim 1, wherein the at least one substrate comprises a plurality of substrates, and wherein the initiation element is positioned on a side of a first substrate of the plurality of substrates and the spark gap is positioned on a side of a second substrate of the plurality of substrates.

3. The initiation device of claim 2, wherein at least one substrate of the plurality of substrates is electrically connected to at least one adjacent substrate of the plurality of substrates with at least one via extending through the at least one substrate, and wherein the initiation element is electrically connected to the spark gap with the at least one via.

4. The initiation device of claim 1, wherein the first side of the at least one substrate opposes the second side of the at least one substrate.

5. The initiation device of claim 1, wherein the initiation element is offset from the leads about a longitudinal axis of the initiation element.

6. The initiation device of claim 1, wherein the initiation element comprises an exploding bridge wire.

7. The initiation device of claim 6, further comprising a first lead and a second lead coupled to the substrate, the first lead and second lead configured to supply the voltage from the control system to the initiation device.

8. The initiation device of claim 7, wherein an axis extending between a portion of the leads coupled to the substrate is transverse to an axis extending along at least a portion of the exploding bridge wire.

9. An initiation device, comprising:

a plurality of substrates, at least one substrate of the plurality of substrates configured to electrically couple with a control system;

an initiation element configured to ignite an energetic material, the initiation element positioned on a side of a first substrate of the plurality of substrates;

a spark gap electrically coupled to the initiation element, the spark gap positioned on a side of a second substrate of the plurality of substrates, wherein the initiation device is configured such that a current resulting from a voltage supplied to the initiation device from the control system passes through the spark gap before initiating the initiation element; and a third substrate of the plurality of substrates, wherein the third substrate is positioned between the first substrate and the second substrate and comprises an aperture that defines a cavity about the spark gap.

10. An initiation device, comprising:

a plurality of substrates comprising:

a first substrate coupled to a first lead and a second lead, the first lead and the second lead configured to supply a voltage from a control system to the initiation device;

a second substrate positioned adjacent to and in electrical connection with the first substrate; and a third substrate positioned adjacent to and in electrical connection with the second substrate, the plurality of substrates configured to electrically couple with Hall the control system, the first substrate electrically connected to the third substrate with at least one via extending through a portion of the plurality of substrates;

an initiation element configured to ignite an energetic material, the initiation element positioned adjacent the third substrate; and a spark gap electrically coupled to the initiation element, the spark gap positioned on the first substrate, wherein the initiation element is electrically connected to the spark gap with the at least one via, and wherein the second substrate comprises an aperture that defines a cavity about the spark gap.

11. The initiation device of claim 10, wherein each substrate of the plurality of substrates comprises at least two vias extending therethrough, wherein a first via of the at least two vias of each substrate of the plurality of substrates electrically connects a first portion of the initiation element to the first lead, and wherein a second via of the at least two vias of each substrate of the plurality of substrates electrically connects a second portion of the initiation element to the second lead.

12. The initiation device of claim 10, further comprising a housing, wherein each substrate of the plurality of substrates is disposed within the housing.

13. The initiation device of claim 10, wherein the initiation device is configured to pass current from a first side of the spark gap, over the spark gap, to a second side of the spark gap, and, from the second side of the spark gap, to the initiation element.

14. The initiation device of claim 13, further comprising an energetic material disposed in a housing adjacent to the initiation element.

15. The initiation device of claim 14, further comprising a second energetic material disposed in the housing adjacent to the energetic material, the second energetic material being less reactive than the energetic material.

16. The initiation device of claim 15, wherein the second energetic material comprises an aperture formed in the second energetic material and configured to form a jet during decomposition of the second energetic material.

17. The initiation device of claim 15, wherein each of the energetic material and the second energetic material comprises a material that decomposes primarily through deflagration.

18. An initiation system, comprising:

a control system; and at least one initiation device configured to be electrically connected to the control system, the at least one initiation device comprising the initiation device of claim 10.

19. A method of igniting energetic material, the method comprising:

supplying a voltage to an initiation device;

passing a current resulting from the voltage through a spark gap formed on at least one substrate of the initiation device;

passing the current through at least one via formed through the at least one substrate of the initiation device; and passing the current through an explosive bridge wire of the initiation device to ignite the explosive bridge wire.

* * * * *